United States Patent [19]

Andreas

[11] Patent Number: 4,604,854

[45] Date of Patent: Aug. 12, 1986

[54] MACHINE FOR FORMING, FILLING AND SEALING BAGS

[75] Inventor: David W. Andreas, Minneapolis, Minn.

[73] Assignee: Golden Valley Foods Inc, Eden Prairie, Minn.

[21] Appl. No.: 557,752

[22] Filed: Dec. 5, 1983

[51] Int. Cl.[4] ..... B65B 9/06

[52] U.S. Cl. ..... 53/552; 53/239; 53/575; 141/392

[58] Field of Search ..... 53/381 R, 431, 445, 53/451, 474, 482, 550, 551, 552, 562, 570, 155, 239, 255, 575; 141/68, 392

[56] References Cited

U.S. PATENT DOCUMENTS

| | | | |
|---|---|---|---|
| 2,160,367 | 5/1939 | Maxfield | 53/551 X |
| 2,295,335 | 9/1942 | Cloud | 53/570 X |
| 2,852,898 | 9/1958 | Berg | 53/552 |
| 3,326,097 | 6/1967 | Lokey | 53/451 X |
| 3,353,327 | 11/1967 | Cutler et al. | 53/551 X |
| 3,777,447 | 11/1973 | Herbine et al. | 53/239 X |
| 3,956,866 | 5/1976 | Lattur | 53/570 X |
| 4,241,563 | 12/1980 | Muller et al. | 53/552 X |
| 4,324,088 | 4/1982 | Yamashita et al. | 53/570 X |

FOREIGN PATENT DOCUMENTS

| | | | |
|---|---|---|---|
| 1440816 | 6/1976 | United Kingdom | 53/551 |

*Primary Examiner*—Robert L. Spruill
*Assistant Examiner*—Steven P. Weihrouch
*Attorney, Agent, or Firm*—James V. Harmon

[57] ABSTRACT

A vertical form, fill and seal packaging machine is described for forming a flat strip of packaging material into a tube and for filling the tube with solid and liquid products which mix in situ within the bags thus formed. Folding blades form gussets in the tube between parallel spaced apart front and rear tube forming surfaces. Sealing jaws seal the filled bags transversely, along the top and bottom edges. Additional pair of jaws seal the gusset material to the side panels at the bottom of the bag causing the gussets in that area to conform to a flat bottom portion of the bag. Additional jaws seal the walls of the bag together to provide a locating seal to keep the product in about the center of the bag and preventing it from falling to the bottom of the bag.

12 Claims, 17 Drawing Figures

FIG. 11
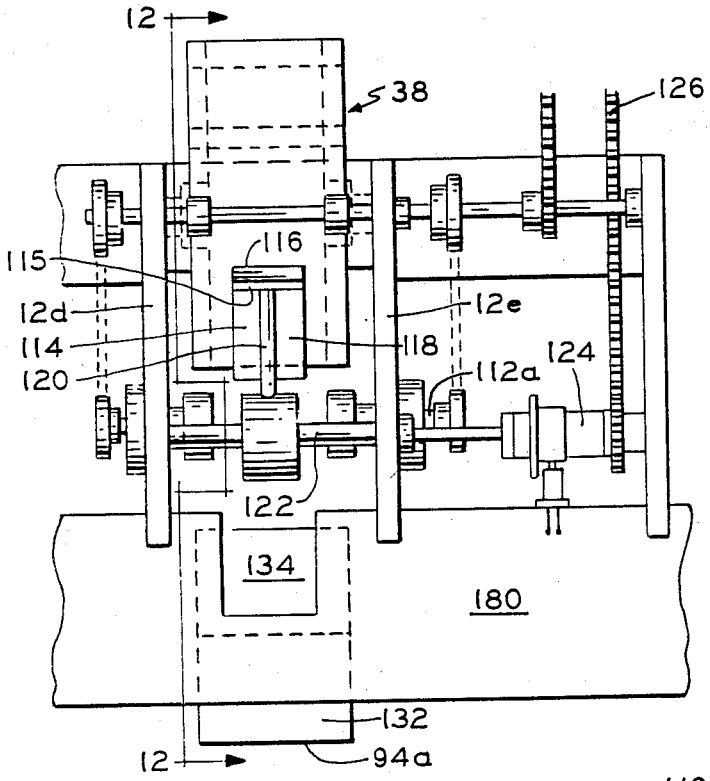
FIG. 12
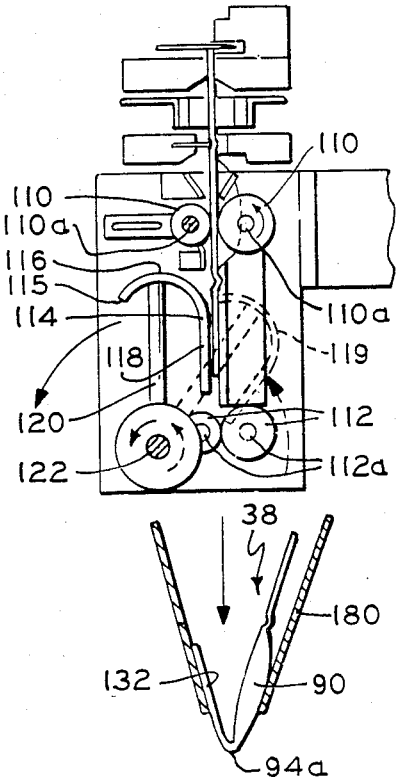
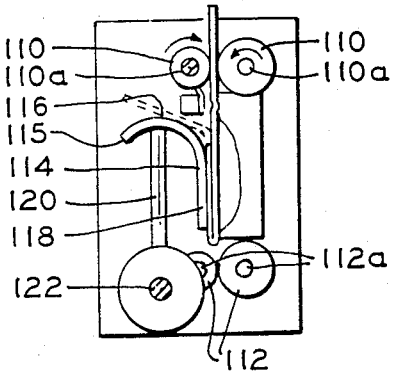
FIG. 13
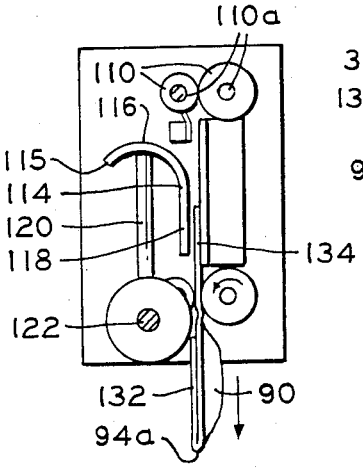
FIG. 14
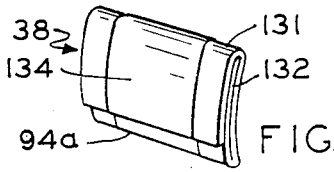
FIG. 15
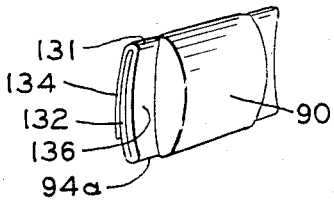
FIG. 16

MACHINE FOR FORMING, FILLING AND SEALING BAGS

FIELD OF THE INVENTION

This invention relates to packaging and particularly to bag forming, filling and sealing machines used for producing filled bags.

BACKGROUND OF THE INVENTION

Various forms of packaging machines are commercially available for the purpose of forming a vertical tube from a long strip of plastic film, paper or other flexible packaging material, for convenience herein referred to as "paper," and at the same time, introducing a product into the paper tube as it is formed, sealing it at its ends and cutting it to separate bag lengths. These prior devices are exemplified by U.S. Pat. Nos. 4,043,098, 4,136,505 and 4,171,605 which describe so-called "tubeless" form fill and seal machines characterized by having a very short fill tube from which back-up members or bars extend in a downward direction to provide a firm support for the operation of vacuum film advancing belt conveyors. U.S. Pat. No. 4,118,913 is similar except that the fill tube can be completely eliminated and the film advanced by means of vacuumized rolls which replace the belt conveyors. Another machine described in U.S. Pat. No. 4,291,520 includes a provision for stripping, clearing and flattening the end seal area of the paper tube.

These prior devices, while excellent for many applications, lack certain features required of the present invention. Machines of the general nature described in the patents are available commercially from Package Machinery Company of East Longmeadow, Mass. Thus, many basic machine elements used in the present invention, including the supporting framework, product distributor and funnel, vertical tube-forming guide and collar, film feeding conveyor, longitudinal seamer, sealing jaw and cut-off operating mechanism, as well as the timer and electric controller are commercially available and are well known to those skilled in the art. Accordingly, they need not be described in complete detail herein.

The deficiencies of the prior equipment in achieving the objectives of the present invention will now be described.

The product introduced into the tube of paper as it is being formed of course falls to the bottom of the freshly made bag. Accordingly, the location of the product in the bag cannot be precisely controlled. Thus, if the bag is pleated or gusseted, the product, normally a granular or particulate material, will be located on both sides of the gussets, i.e., between the gusset folds and each face. In addition, there is no way to keep the product centered in the bag intermediate the sealed ends. Instead, it is usually strung out between the top and bottom end seal. However, it is desirable for some applications to locate the product in a clump or mass about half way between the cut ends of the bag with one or both faces curved or blistered outwardly at that point to accommodate it. This may have application in a wide variety of applications such as product packed in a large display bag or for situations in which a bag is used at times to hold a smaller than normal product or quantity or, in the case of products that expand before they are removed from the bag. This would apply to expandable chemicals or foods which are hydrated and swell up while still in the bag or to popcorn that is intended to pop in the bag or even to bread and biscuit dough that is proofed or cooked in the bag. It can also be applied in packaging toys or hardware items that should be positioned precisely on center and at right angles to the ends of the bag. In the prior devices, products simply fall to the end of the bag and are located helter-skelter adjacent the bottom seal.

Another objective of the invention is to provide a means for forming deep gussets and especially an effective way to form a bag with gussets that have center creases or fold lines that touch each other or practically touch at the center of the bag and to bags in which one face of the bag is smaller in width than the other, e.g., a front face three inches wide and a back face five inches wide with gussets that touch at the center. As far as is known, there has been no provision for shaping bags produced on form, fill and seal machines in this way and at the same time, introducing product as desired into one side or both sides of the central gusset folds. When a belt or roller feed conveyor is used, it engages the sides of the tube from which bag lengths are cut and only one tube or compartment is present. An objective of the present invention is to form the flexible tube into two portions, one of which is preferably flat or collapsed and the other of which is expanded, then at the proper time, advance the tube by a conveyor means engaging only one of said two portions of the bag. For example, an optional conveyor is contemplated which may engage only the collapsed part of the bag and not the expanded portion.

Another problem with prior equipment is the lack of a provision for folding the filled bags transversely. The bag simply retains its pillow-shape after being severed from an adjacent bag. By contrast, it is an objective to fold one or both ends of the bag along transverse fold lines to bring the end seals to a position adjacent the center of the bag and to perform this operation automatically as the bags descend from the filling and sealing station.

Yet another problem with prior equipment is the lack of a provision for filling the bags with two different products simultaneously, particularly a liquid and a solid product. For example, in the case of foods and chemicals, it may be desirable to fill the tube with a liquid such as an oil and a solid such as a dry granular food, e.g., vegetable oil and unpopped popcorn. If liquid and solid materials were both introduced into the feed hopper above the fill tube, machine parts would become covered with oil creating an unsanitary condition by attracting dust. Moreover, the same quantity of oil might not be distributed to each successive bag.

These and other deficiencies of the prior art will be apparent from the following description setting forth certain illustrative embodiments of the invention by way of example.

THE FIGURES

FIG. 11 is a front view of the bag folder on a larger scale than in FIG. 1.

FIG. 12 is a side view of the folder during the first stage of folding a bag.

FIG. 13 is a view similar to FIG. 12 showing a later stage of the folding operation.

FIG. 14 is a view showing a final stage of folding.

FIG. 15 is a perspective view of the front of a folded bag.

FIG. 16 is a perspective view of the rear of a folded bag.

FIG. 17 is a side view of another form of jaw.

SUMMARY OF THE INVENTION

Figure 1:
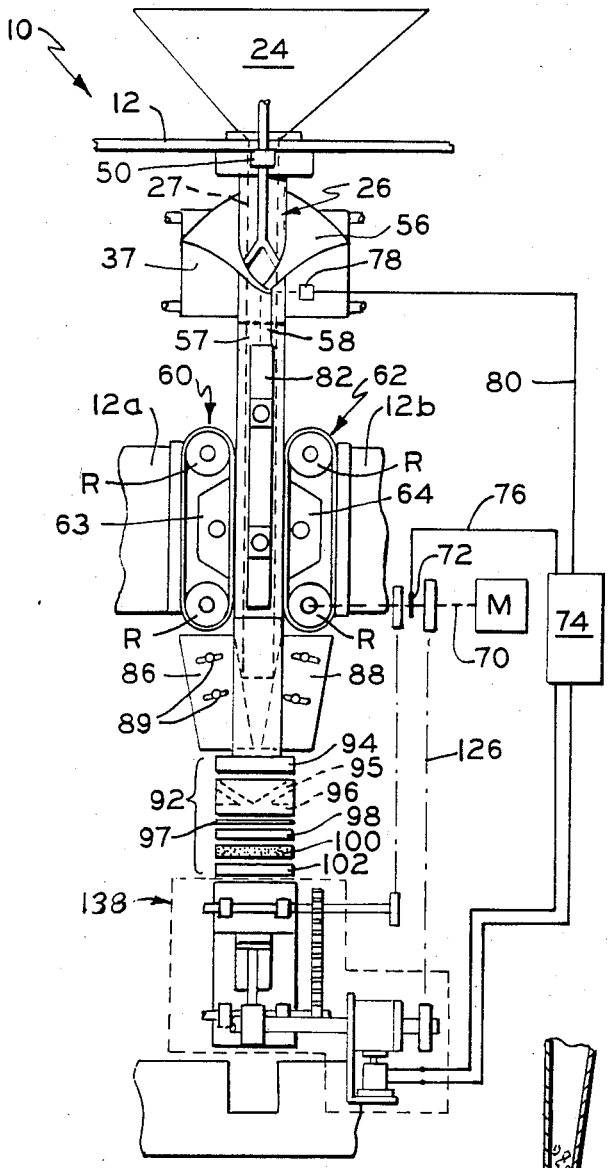
FIG. 1 is a front elevational view of the invention.

A form, fill and seal packaging machine is provided with a supporting framework at the top of which is mounted a distributor positioned above a funnel to which is secured a downwardly depending tubular sheet forming guide around which extends a tube forming collar, all of conventional construction. Flexible packaging sheet material is drawn from a roll conventionally over the collar and is advanced preferably intermittently in a feed zone including opposed conveyors also of conventional construction that engage the sheet.

The sheet forming guide is of unique configuration and includes (a) a vertical fill tube as well as (b) two adjacent forming surfaces spaced laterally from it and extending longitudinally thereof to form the sheet into an expanded flexible tube and flattened flexible tube portions. Adjacent the fill tube is a downwardly depending fluid supply pipe used when required to introduce any desired liquid into the paper tube. Solids are introduced through the fill tube.

Below the sheet forming guide is a pair of cooperating laterally spaced apart centrally moveable heated jaws or sealing bars which are preferably composed in descending order proceeding from top to bottom of (a) bottom product locating seal; (b) bottom gusset seal; (c) bottom bag end seal; (d) cut-off knife; (e) bag top seal; (f) bag deflating cushion; and (g) top product locating seal. When present, the two product locating seals provide a central compartment in each successive bag to hold the product being packaged.

Below the pair of jaws and cut-off is a bag folder which may take one of two forms: (A) a rotating folding blade having a leading edge which defines a bag engaging blade that strikes the bag on one face folding it to the side at which point rotation of the guide stops while a bag feed conveyor continues to advance the bag. The guide includes a downwardly-curved folding shoe on a rearward surface adapted to fold the deflected portion of the bag centrally. The other end of the bag is similarly folded in any convenient manner. (B) In an alternative folding method, an inclined guide is used to deflect the end of the bag to one side as the bag is struck by the inclined face causing it to bend along a transverse fold line. Folding of the end section of the bag toward the center of the bag can then be completed by allowing the bag to fall into a receiving trough or other receptacle.

The provision of two forming blades and adjacent fill tube with positive drive means for the paper tube as it forms, results in an open cavity on one side of the bag to hold product while the fluid supply pipe adjacent to the forming tube allows both liquids and solids to be reliably introduced simultaneously without mixing until in the bag. Thus, mixing occurs in situ within the completed bag. At the same time, the bottom product locating seal members bond the plies of the bag together above its lower end to define the lower aspect of a product compartment at the center of the bag. This seal, when used, keeps the product from falling to the lower end of the bag. The upper product locating seal prevents product from sliding upwardly when the bag is inverted.

DESCRIPTION OF THE PREFERRED EMBODIMENTS

Figure 2:
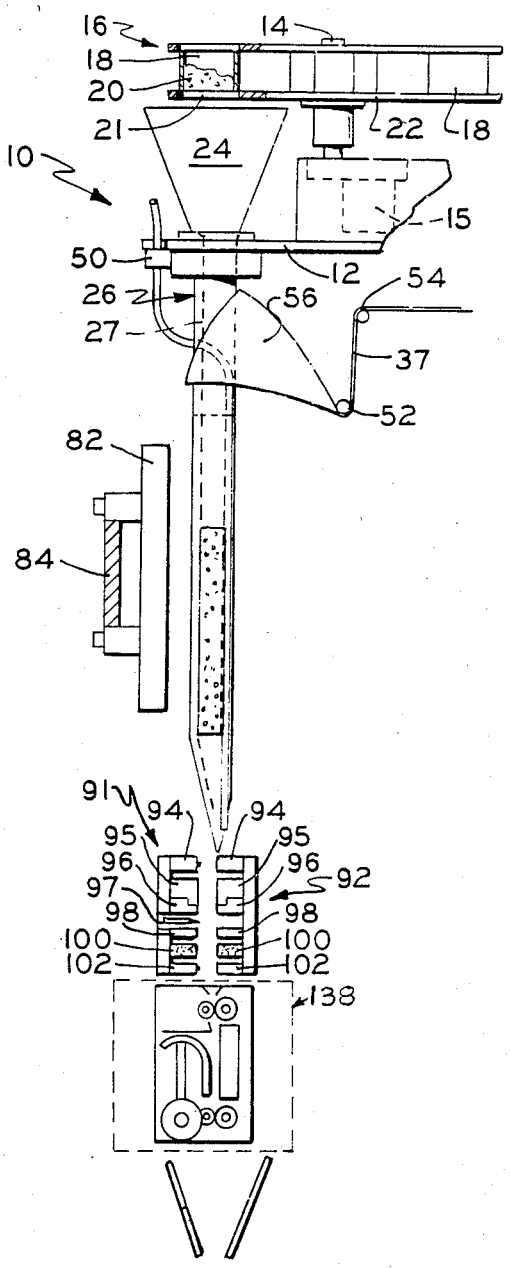
FIG. 2 is a side elevational view of FIG. 1.

Refer now to FIGS. 1 and 2 which illustrate a form, fill and seal packaging machine in accordance with one form of the present invention. The machine 10 includes a supporting framework 12, 12*a* and 12*b* (only parts of which are shown) of conventional construction. Mounted for continuous rotation on a vertical shaft 14 drawn by motor 15 is a distributor 16 having a plurality of spaced-apart compartments 18 adapted to hold a volumetrically fixed quantity of product 20 adapted to fall upon reaching an opening 21 in a stationary support plate 22. The product 20 is usually a solid particulate, granular, powdered material or other freeflowing solid.

The plate 22 is circular in shape with an opening 21 aligned over a funnel 24. When each successive rotating compartment 18 passes opening 22, the product therein will fall into the upwardly open mouths of the funnel which is supported at its lower end from the frame member 12. The dispenser 16 is conventional. Any other suitable dispenser can be used.

Communicating with the funnel 24 and extending downwardly from it is a paper tube forming guide 26 including a product supply pipe 27 that is hollow and cylinder-shaped.

Figure 4:
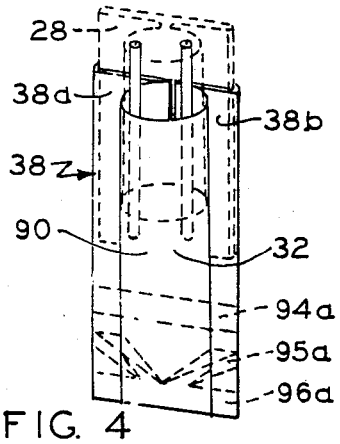
FIG. 4 is a diagramatic perspective view of one bag section of a strip of sheet material at the point on the forming and filling machine at which filling takes place.
Figure 3:
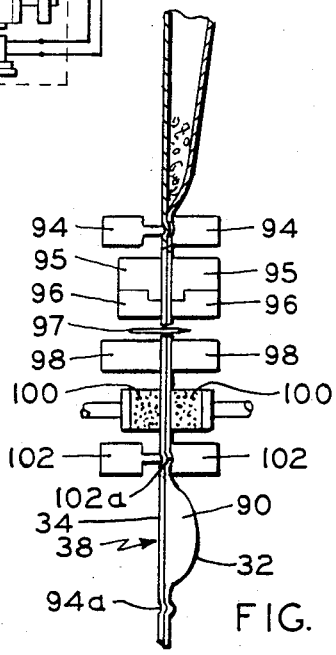
FIG. 3 is a partial cross-sectional view of the transverse sealing jaws as they appear engaged on a section of flexible packaging material.

At the lower end of the paper tube former are provided two longitudinally extending parallel front and rear forming plates 28 and 30 defining parallel paper guide surfaces 28*a* and 30*a*, respectively, that produce the opposing faces 32 and 34 of each resulting bag 38 (FIGS. 3 and 4) formed from paper supply stock 37. The upper ends of the plates have smooth rounded contours at 40 and 42 to prevent tears in the paper stock 37. The plates are supported on the tube 27 by three vertically spaced-apart generally rectangular standoffs 29, each having an opening for tube 27 and each welded to the tube 27 and at its ends to the plates with plate 28 spaced further from tube 27 than plate 30. The lower end of plate 28 is bent or deflected toward tube 27 and of uniform width while plate 30 is straight paralleling the axis of the tube 27 but has converging side edges 30*a* and 30*b* at its lower end. The plates 28 and 30 have longitudinally extending slots 28*c* and 30*c* projecting vertically from their lower ends. Each of slots 28*c* and 30*c* is of about the same width as tube 27 causing the lower ends of the plates 28 and 30 to be bifurcated with spaced end portions 28*d* and 30*d*, respectively on opposite sides of the tube 27. The discharge ends 44 and 46 of liquid supply pipes 45 and 47 are also located on opposite sides of the tube 27. These pipes can be used to supply various liquids such as liquified shortening which then mixes with the solid product 20 in situ within the newly formed bag 38 but is held out of contact with the product 20 prior to that time. The oil is supplied through an electrically timed solenoid operated dispensing valve 50 mounted on frame member 12. Inspection slot 28*c* is optional.

The advancement and forming of paper supply strip or web will now be described with reference to FIGS. 1–4.

As shown in FIGS. 1 and 2, the paper strip 37 is supplied as a continuous piece over idle rollers 52, 54 from a supply roll (not shown) and can consist of paper, flexible plastic or flexible laminates thereof for convenience referred to as "paper" which passes next over a metal forming collar 56 of conventional known construction for the purpose of producing a paper tube 57 with adjacent overlapped edges 58 (FIG. 1). The paper tube 57 is advanced by intermittently actuated parallel opposed porous motor driven conveyors, including belts 60 and 62 entrained over rollers R. The belts engage the paper tube 57 through the effect of a vacuum supplied by interior vacuum boxes 63 and 64. The conveyors are supported on laterally spaced-apart stationary frame members 12*a* and 12*b* and each is driven during operation by a drive motor M via shaft 70 including an intermittently operated clutch 72 to thereby advance the paper at timed intervals set by an electric controller 74 connected thereto by conductor 76 and to a photocell 78 by conductor 80 (FIG. 1). In operation, the photocell 78 senses timing marks on the paper 37 to thereby engage or disengage the clutch 72 to stop the paper feed intermittently when each successive bag reaches its cut-off point. The conveyors are conventional and can be as described in U.S. Pat. No. 4,136,505.

A longitudinal seal, prefereably a heat seal at the overlap 58, is produced by a heated longitudinal seal forming bar 82, supported from a bracket 84 suitably connected to the framework 12. The construction and operation of bar 82 is conventional.

The bag 38 includes gussets 38*a* and 38*b* (FIG. 4) that are formed by vertically disposed laterally spaced-apart canted gusset-forming blades 86 and 88 which extend at their lower ends between the lower ends of forming plates 28 and 30 to draw the paper into the area between them. Blades 86 and 88 are supported by bolts 89 extending through slots in the blades to allow precise positioning. Since the plate 30 opposite the paper overlap 58 tapers at its lower edges 30*d*, the corresponding face 32 of bag 38 becomes narrower than the opposite face 34. This produces a bag with a product storage compartment 90 (FIG. 3) that is somewhat less in width than the full width of the bag 38 for better visual display of the product or for technical advantages, e.g., to permit the product, such as chemicals or food, to expand in the bag to a volume many times greater than the compartment 90 as the gussets unfold. The product filling tube 27 has a front flat oblique wall 27*a* at its lower end and an aligned rear slot or cut-out section 27*b*. In this way, the oblique wall 27*a* acts as a deflector forcing the product 20 out through the rear slot 27*b* into the product storage pocket 90 laterally of tube 27.

During operation, the interaction between the curved front plate 28 and the straight rear plate 30 causes the paper tube to travel downwardly in a straight line while at the same time providing adequate space in the rear half of the bag to form the pocket 90. Transverse sealing and cutting will now be described with reference to FIGS. 1 and 2. As shown in the figures, a pair of separable laterally aligned cooperating jaws 91 and 92 are provided. The jaws are supported on frame 12 for movement together or apart with a suitable pneumatic or electric actuator of known construction provided for this purpose.

The construction of the unique sealing and forming portion of the jaws will now be described proceeding from top to bottom.

At the top is a pair of optional product locating bars 94 for forming an optional lower product locating seal 94*a*.

Next are a pair of gusset seal bars 95 for forming gusset seals 95*a*. The special internal gusset seals 95*a* are highly beneficial in sealing the gusset folds to the adjacent panels. This provides a unique square bottom bag which is self-opening and unobstructed by the gusset ends that would otherwise be pinched in the bottom end seal of the bag. Instead, the gussets are folded to extend laterally at the bottom conforming to the flat bottom of the bag when expanded. This special gusset seal also strengthens the bag bottom, assuring that the top will open more readily than the bottom, see copending application Ser. No. 522,268 filed Aug. 11, 1983. Below seals 95*a* are bag bottom seal bars 96 which produce the bag bottom seal 96*a*.

Next is a bag cut-off knife 97 which is suitably actuated to operate prefereably just after the jaws come together to sever the bags from one another.

Next are a pair of top seal bars 98 which seal the top of the bag that was previously sealed at the bottom in the previous sealing cycle.

Next below bars 98 are resilient members such as sponge rubber pads 100 used for collapsing the top portion of the bag and finally optional sealing bars 102 for producing an optional top product locating seal 102*a*. Together, the seals 94*a* and 102*a* when used center the product 20 in the bag. Of these, seal 102*a* appears to be the most useful because it will be noted that it can be used to hold the product up, i.e., away from the bottom seal 96*a*, during the filling operation. All of the sealing bars can be made of metal and contain electrical heaters to keep them at a temperature of say 200° F. Any suitable known actuators can be used for opening the jaws and closing them at timed intervals corresponding to the moment the belts 60, 62 stop running.

One form of bag folder will now be described by reference to FIGS. 1, 2, and 11–14. Mounted on upright frame elements 12*d* and 12*e* are two pair of cooperating aligned bag advancing roll sets 110 and 112 which are supported with their shafts 110*a* and 112*a* journaled for rotation in given feed directions to advance the bags downwardly. Between the rolls 110–112 is a moveable folding blade or plate 114 having a leading bag engaging edge 115. A curved bag folding section 116 extends toward the axis of motion of the bag defined by a plane extending between rolls 110 and 112. The folding section 116 is co-extensive with a guide section 118 consisting of a flat plate positioned in the plane of the rolls 110–112 when the blade 114 is in its normal stationary solid line position shown in the figures. The blade is mounted on a support arm 120 secured to shaft 122 which is journaled for rotation in frame members 12*d* and 12*e*. Shaft 122 is connected via clutch 124 to a chain and sprocket assembly 126 that is coupled to motor M. The clutch 124 is automatically engaged only when clutch 72 is disengaged and is constructed and arranged to enable the shaft 122 and blade 114 to rotate through 360° and stop before the rolls 110 and 112 are again started. The result is that near the end of the 360° rotation, the leading bag deflecting edge 115 of the blade 114 will strike the lower end of a stationary bag moving it to the left in the drawings. This happens when the blade 114 is in the dotten line position of FIG. 12. The rolls 110–112 are then started causing the bag to move downwardly and since its lower end is held up by the curved bag folding section 116, the lower end of the bag shown in dotted lines in FIG. 13 will be folded upwardly along a line which corresponds to the lower product locating seal 94*a*.

The downward motion then continues with a portion 118 of the blade serving as a guide so that the fold at 94*a* enters between rolls 112 which help to crease the fold. The bags then fall into a receiver such as a V-shaped trough 180 (FIG. 12). A final fold 131 can be formed manually or automatically if desired in any known way to provide a complete package with end sections 132 and 134 folded centrally over a center section 136 where the product compartment 90 is located (FIGS. 15 and 16).

In this way, a compact package is formed with the filled compartment 90 at its center, the pouch being narrower in width than the width of the bag 38. It can also be seen that the centrally extending gusset material separates the pouch or compartment 90 from the part of the bag on the other side of the gussets from compartment 90 until the bag is expanded.

The bag folding mechanism 138 (FIGS. 11–14) which is shown in dotted lines in FIGS. 1 and 2 is optional. An alternative bag-folding mechanism will now be described with reference to FIG. 17. Shown in FIG. 17 are a pair of horizontally aligned cooperating moveable jaws indicated generally at 150 and 152. These jaws are generally similar to the jaws described in FIGS. 1, 2 and 3 above and the same numerals refer to corresponding parts. Certain differences exist which will now be described.

The jaws forming respectively the lower product locating seal, the bottom gusset seal, the bag bottom seal and the top seal of the lower most bag are designated 94, 95, 96 and 98. Between the bag bottom sealing jaws 96 and the bag top sealing jaws 98 is a moveable cut-off blade which, during operation at the time the jaws are closed, moves from the position shown into a recess 97*a* thereby cutting off each successive bag from the bag just preceeding it.

During operation, the jaws are moved toward one another into engagement with the bags located between them by means of any suitable actuator of the type ordinarily used on form, fill and seal machines of the general type described. The timing of the jaw closing function is regulated by a suitable electric controller such as the controller 74 of FIG. 1. Mounted on each jaw 150 and 152 is a bracket 154 positioned below the top sealing jaw 98. Each bracket extends toward the plane of engaement between the jaws and includes a downwardly projecting leg portion 156. Mounted upon the bracket 154 against the vertically extending leg portions 156 are resilient bag deflation members such as foam rubber sheets 158 and 160 in the case of jaws 150; 162 and 164 for jaws 152. When the jaws 150, 152 approach one another at the center, they engage the product containing compartment 90 of the bag 38 on either side, yieldably exerting pressure against the walls of the bag to force air from around the product and deflate the bag. By helping to press air out of the bag in this manner, the finished bags can be more reliably folded to the condition shown in FIGS. 15 and 16.

As can be seen in FIG. 17, the lower end of the right hand bracket 156 includes a horizontally disposed centrally extending section 170 having a bend 172 at its central end. From the bend 172 the bracket extends downwardly and centrally on an inclined plane, defining a guide or deflector plate 173 which terminates at a free lower edge 174. The intermediate horizontal section 170 extends a short distance as for example, an inch or inch and one-half centrally of the deflating member 162.

During operation, when the jaws 150, 152 are moved centrally against the freshly formed paper tube, the bottom temporary seal or product locating seal formed by the jaws 94 and the gussets are sealed to the lower portions of the bag faces by the jaws 95. The bottom of the bag is sealed by means of jaws 96, and the bag is then cut off by the knife 97. Simultaneously, jaws 98 engage the next succeeding bag below and seal the top edges thereof together. All of the jaws 94, 95, 96 and 98 are provided with suitable internal electric heaters 175.

As the bag is being sealed in this manner, the resilient sponge rubber deflation sheets 160 and 162 press the sides of the center portion of the bag lightly driving any air contained therein upwardly through the top of the bag. It will be noted that the deflation member 162 extends centrally somewhat beyond the edges of the jaws thereby striking the bag 38 before the jaws have been completely sealed. In this way, it is assured that air will begin to flow out of the bag before the top seal has been formed. As the jaws come together, the guide or deflector member 173 and the bend 172 will strike the lower portion of the bag below the product locating compartment 90. It will be seen that the center section 170 and bend 172 is positioned at the same elevation as the product locating seal 94*a*. As a result, the contact between the deflector 173 and bend 172 will force the lower portion of the bag 132 toward the left as shown in FIG. 17 to a more or less horizontal position. When the jaws then quickly open, the lower most bag will be free to fall downwardly into a generally V-shaped trough 180 having side walls which hold the bag 38 with the lower end portion 132 folded upwardly from a transverse line which corresponds with the lower product locating seal 94*a*. In this way, the resilient deflation member 160 serves as a back-up element that holds the center portion of the bag stationary as the upper end of the deflector 173 bends or folds the bag at the lower product locating seal, causing the lower end portion 132 of the bag to be in a raised position at the time it is allowed to fall freely from the jaws so that portion 132 will be engaged by the V-shaped trough 180 and thereby folded upwardly as it falls. It will be seen that in this embodiment of the invention, all of the moving parts of the bag folding device previously described have been eliminated. Moreover, the optional top product locating seal has not been made and the corresponding top product locating seal bars 102 are not present in this embodiment, but could be used if desired.

While the jaws can be of various materials, steel jaws are preferred. It will be seen that the jaws 94 as best shown in FIG. 17 include a protruding jaw element in strip form designated 190 which projects into an aligned groove 192 in the opposite jaw. This provision causes the paper engaged there-between to be creased or folded at the same time that it is sealed. This provision aids in folding the bag along the temporary seal line 94*a*.

Figure 5:
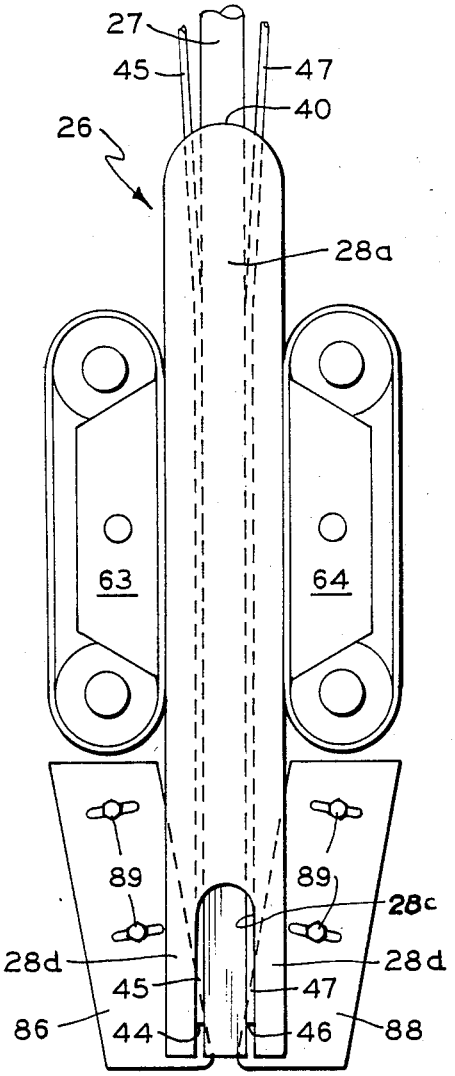
FIG. 5 is a front elevational view of the tube forming guide and associated structure on a larger scale.
Figure 6:
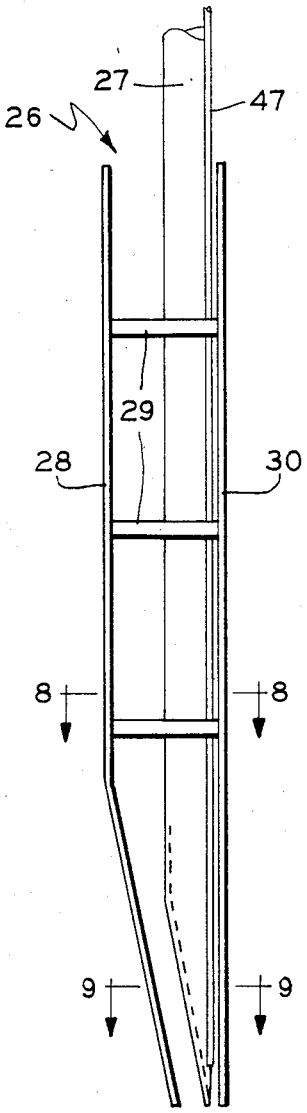
FIG. 6 is a side elevational view of the guide shown in FIG. 5.
Figure 7:
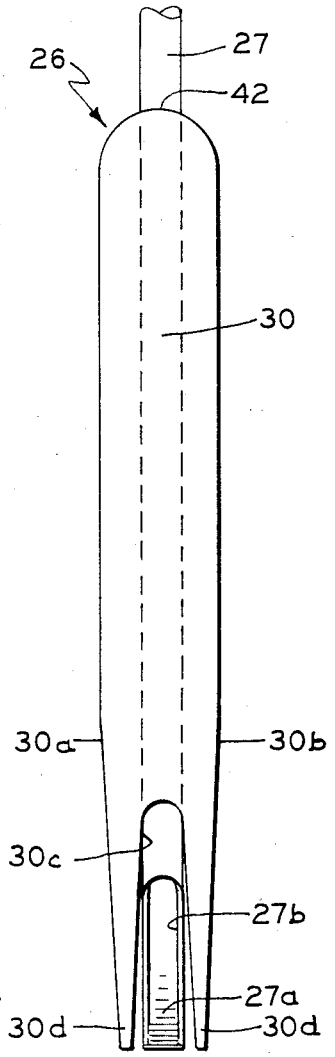
FIG. 7 is a rear view of the guide.
Figure 8:
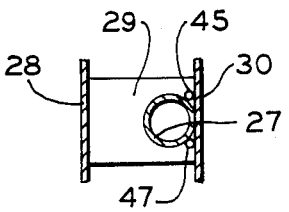
FIG. 8 is a transverse sectional view taken on line 8—8 of FIG. 6.
Figure 9:
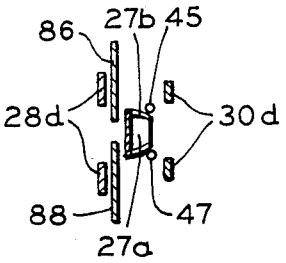
FIG. 9 is a cross-section taken on line 9—9 of FIG. 6.
Figure 10:
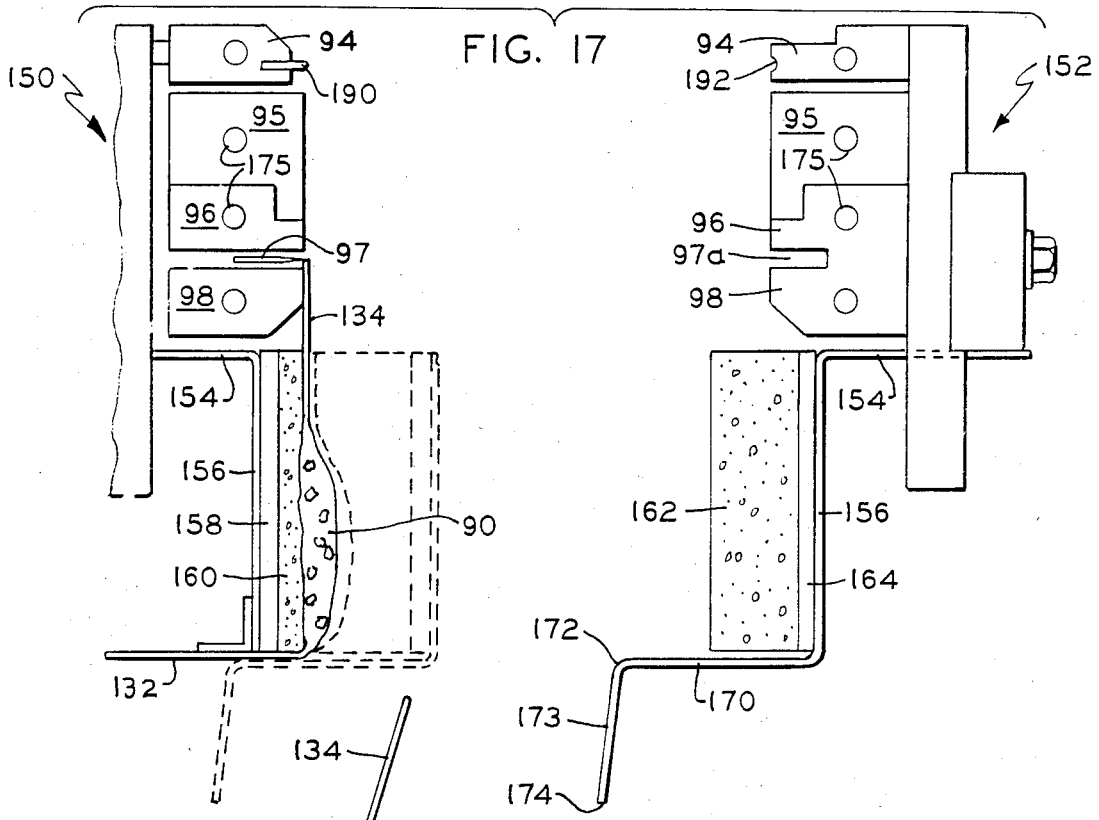
FIG. 10 is a perspective view of the lower end of the tube former.
Figure 10:
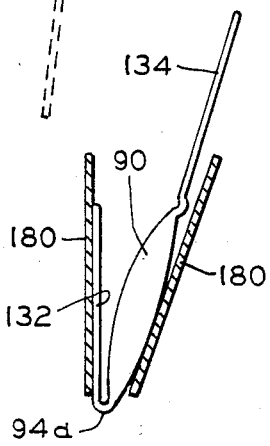
Figure 10:
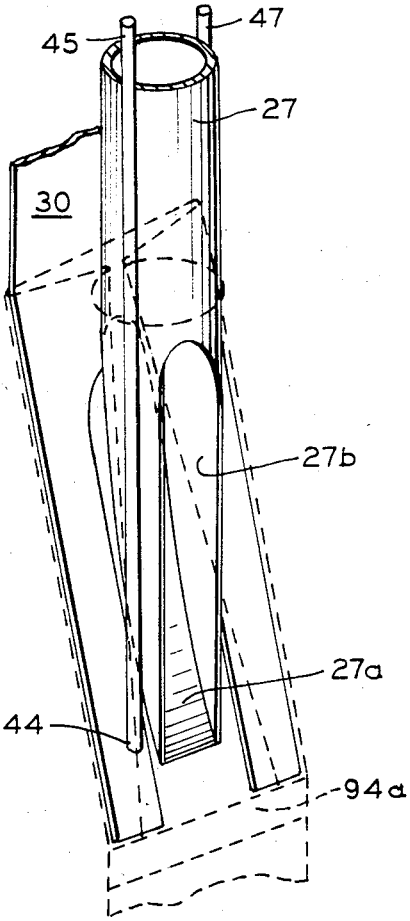

The tube former shown in FIGS. 5, 6 and 7 is preferably of the square type in which front and back are formed. If desired, it may be of the round type, in which case, the tube is at least initially round before gussets are formed. While the tube being formed is generally rectangular in shape at least initially, it should be noted that the term "tube" is used in the broad sense and is not construed as limited to a square or cylindrical tube or to a tube of any other particular shape. The terms "vertical," "horizontal," "forwardly," "rearwardly," and "depending" or similar terminology denoting geometrical or spacial relationships are employed for convenience and are not intended to limit the claims.

The longitudinal sealer 82 can comprise either a bar sealer that is heated electrically or belt sealer. However, in either case, it is preferred that a suitable retractor be provided for withdrawing the heated sealing bar from the paper when the machine is turned off or the paper is not being advanced to prevent the paper from being overheated or possibly burned. The construction and operation of the longitudinal sealer 82 can be as described in any of the aforesaid patents and the timing thereof controlled by the machine controller 74 so that its operation is synchronized with the other machine functions.

From the description provided, it will be apparent that the improved packaging machine of the present invention provides a highly effective and efficient means for forming filled packages comprising flat gusseted bags formed from paper, paper laminates or other flexible packaging materials in which the product to be shipped therein is held in a small compartment at the center of the bag between in-folded gussets and one face which in a preferred embodiment is smaller than the opposite face of the bag; that is to say, has its side edges spaced inwardly from the side edges of the bag. The product locating seals formed by the bars 94 and 102 will effectively hold the packaged product within the compartment 90 and will prevent it from being transferred to the ends of the bag. In addition, the separate liquid supply pipes 45 and 47 will reliably deposit liquids within the bag at the same time that solid products 20 are introduced but without allowing them to mix before actually entering the bag. In this way, the liquid and solid components will become mixed in situ within the bag. Provision is also made for folding the bags transversely along transverse fold lines located at the upper and lower edges of the product compartment and a further provision is made for forcing air from the bag just prior to sealing each successive bag at the top.

What is claimed is:

1. A vertical form, fill and seal packaging machine for forming bags from a source of flexible packaging material in the form of an elongated flat strip of uniform width making up successive blanks corresponding to successive bags formed by the machine, said machine comprising a supporting framework, a dispenser located at the top of the supporting framework and adapted to expel quantities of a first product successively into succeeding bags during operation, a vertically disposed tube former adapted to receive the strip of sheet material and to form the sheet material as the sheet material is advanced to a downwardly extending, upwardly open tubular configuration and at the same time, bring the opposite longitudinal edge portions of the sheet material as it is advanced into overlapping relationship to provide a vertically extending longitudinal seam extending from the top of each successively formed bag to the bottom thereof, a funnel supported on the framework below the dispenser and said funnel opening upwardly and being adapted to receive the fresh product expelled from the dispenser, a tubular product transfer tube extending downwardly from the funnel and communicating with the funnel, to receive the product introduced therein from the dispenser, said product transfer tube extending downwardly and opening at its lower end at a discharge point enabling the product to transfer through the tube to each successive bag passing the discharge point, a liquid product introducing means having an upper end portion adjacent the upper end of the product transfer tube and extending downwardly through the tube former, first and second vertically disposed longitudinally extending parallel laterally spaced-apart tube forming plates fixedly disposed on opposite sides of the product transfer tube, said plates being adapted to form front and rear surfaces of the bag, gusset-forming blades releasably mounted between the plates for forcing portions of the flexible tube into a region between the plates to thereby form gussets in the resulting tube and bag produced therefrom, sealing means for sealing the longitudinal overlapped edges of the flexible tube, drive means for advancing the flexible sheet material in a downward direction, transversely disposed laterally aligned bag sealing jaws mounted below the lower end of the product transfer tube, including first and second bar pairs for sealing the top and bottom of the bag and a third pair of bars for pressing the walls of the tube together just before the product is dispensed into the tube along a transverse line intermediate the ends thereof to locate the product in the bag immediately above a transverse line of contact that divides each bag into separate upper and lower compartments one above the other to keep the product in the bag from falling to the lower end of the bag and a means for cutting off successive bags from one another at a point located between the top and bottom seal jaws so that the bags being formed are thus severed from one another in succession, whereby during operation a solid product and liquid product are simultaneously introduced into the bag and allowed to mix in situ within the bag while the transverse line of contact holds the liquid and solid product above the line of contact within the bag and spaced centrally from the lower end of the bag.

2. A vertical form, fill and seal packaging machine as set forth in claim 1 wherein a second pair of bars are provided in the jaw and are located to extend transversely across each successive bag at a point between the upper end of the bag and the transverse line of contact to thereby define an upper line of contact between the walls of the bag to prevent the product within the bag from being transferred to the top end of the bag.

3. A vertical form, fill and seal packaging machine as set forth in claim 1 wherein the lower end of the second forming plate has a central, vertically-disposed slot therein extending upwardly from the lower edge whereby the lower end of the second plate is bifurcated and includes spaced apart vertically disposed tube forming elements at its lower end and the product transfer tube has a side opening on the side facing the second plate extending from its lower end upwardly, said side opening is located at a point where the product is emptied into each successive bag whereby the product in the tube can be transferred toward the side out of the side opening in the product transfer tube and through the slot in the second forming plate.

4. The vertical form, fill and seal machine as set forth in claim 3 wherein the product filling tube is provided with an inclined wall aligned with the side opening and being inclined with its lower end extending toward the lower end of the side opening in the tube whereby the inclined wall in the fill tube will force product falling therethrough out through the side opening in the tube.

5. The apparatus of claim 1 wherein each of the forming plates includes vertically disposed parallel side edges, the side edges of one plate are spaced closer together than the side edges of the other plate whereby the flexible sheet material formed into a tube thereby will have one narrower face corresponding to the forming plate with the more closely spaced side edges.

6. The appartus of claim 1 wherein one of the forming plates has a lower end section positioned on an incline proceeding downwardly with its lower end closer to the fill tube than the upper end thereof whereby the tube as it is formed will be guided in the direction of the product filling tube.

7. The appartus of claim 1 wherein said jaws comprise the following jaw elements proceeding from top to bottom, a pair of bars for forming a lower product locating seal, next a pair of bars for sealing the gussets together, below that a pair of bars for sealing the bottom of each successive bag, bag cut-off means and a top sealing jaw forming the top seal of each succeeding bag.

8. The apparatus of claim 7 wherein a transverse bag folding means is provided including means for supporting the bag and a deflector means at the lower end of one of the jaws to deflect a lower portion of the bag laterally to thereby begin folding the bag such that a lower section of the bag is folded upwardly against the center section of the bag.

9. The appartus of claim 1 wherein a bag folding means is provided beneath said transverse sealing jaws, said bag folding means comprising a bag folding blade rotatably mounted on said appartus, said blade having a leading edge adapted to engage the side of the bag when the blade is rotated, a curved bag folding section adjacent the leading edge of the blade and a flat guide section adjacent to the curve section normally located in a vertical position to guide the bag downwardly with the portion of the bag deflected by the leading edge of the blade folded upwardly against a center section of the bag and drive rollers adapted to engage the bag and to advance the bag past the rotatably mounted folding blade.

10. The apparatus of claim 9 wherein intermittently operated drive means is provided for rotating the bag folding blade upon its axis of rotation through an angle of 360° with the rotation starting at a point in a cycle of operation wherein a bag is stationary and is located with its lower end positioned to be engaged by the leading edge of the blade whereby the leading edge of the blade will deflect only the lower end of the bag toward one side to begin folding the bag transversely at a point intermediate its end.

11. The appartus of claim 1 wherein said jaws comprise a pair of bag bottom sealing bars and immediately thereabove a pair of bag gusset sealing bars adapted to seal the bag gussets to adjacent front and rear bag face panels in the lower portion of the bag whereby the portions of the gussets thus sealed are able to fold laterally to conform to a flat bag bottom wall.

12. In a vertical form, fill and seal packaging machine for forming bags from flexible packaging material including a tube former for forming packaging material into a tube with overlapping edges to provide a series of flexible packages, a dispenser for a product and a product transfer tube having an inlet at its upper end and, extending downwardly through the tube former and a drive means for advancing the flexible packaging material over the tube former and downwardly around the transfer tube, the improvement comprising first and second vertically disposed longitudinally extending spaced apart tube forming plates disposed on opposite sides of the product transfer tube to form the front and rear surfaces of the bag with gusset forming blades between the plates for forcing portions of the flexible tube into a region between the plates, said plates having substantially parallel upper portions and lower portions having lower ends which converge toward one another proceeding toward their lower ends in the region of the gusset forming blades, said transfer tube having a side opening at its lower end adapted to expel product passing downwardly therethrough laterally toward one side of the bag, one of said plates adjacent to the opening in the dispensing tube having a vertically disposed slot therein extending upwardly from its lower end, whereby the end of the second plate is bifurcated and includes spaced apart vertically disposed tube forming elements at its lower end and the side opening of the product transfer tube is located at a point where the product is emptied into each successive bag so that the product in the tube is transferred toward the side through the slot in the forming plate, the product transfer tube having an inlet adjacent the dispenser and a liquid fill tube is provided having an upper end portion adjacent the inlet of the dispensing tube and extending downwardly parallel to the transfer tube through the tube former such that the flexible packaging material is formed into a tube around both the liquid fill tube and the product transfer tube and the liquid fill tube extends a substantial distance toward the bottom of the product transfer tube to prevent significant mixing of the liquid and product in the product transfer tube whereby mixing thereof occurs in situ within bags formed from the flexible packaging material and valve means operatively connected to the liquid fill tube to control the flow of liquid therethrough into the bags as they are formed and sealing members for bonding the tube of packaging material to itself at spaced apart intervals thereby forming a succession of bags.

* * * * *